US007196280B2

(12) United States Patent
Rochon

(10) Patent No.: US 7,196,280 B2
(45) Date of Patent: Mar. 27, 2007

(54) MINIATURIZED ELECTRIC SWITCH

(75) Inventor: Sylvain Rochon, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 21 days.

(21) Appl. No.: 11/473,783

(22) Filed: Jun. 23, 2006

(65) Prior Publication Data

US 2007/0007119 A1 Jan. 11, 2007

(30) Foreign Application Priority Data

Jul. 7, 2005 (FR) ..... 05 52083

(51) Int. Cl.
*H01H 5/30* (2006.01)

(52) U.S. Cl. ..... 200/406

(58) Field of Classification Search .... 200/16 R–16 D, 200/405, 406, 449, 450, 453, 456, 459, 460, 200/461, 516, 520, 534, 535
See application file for complete search history.

(56) References Cited

U.S. PATENT DOCUMENTS 3,120,590 A * 2/1964 Dahlin ..... 200/460
4,177,367 A * 12/1979 Tirone et al. ..... 200/535
4,394,553 A 7/1983 Feil
4,484,042 A * 11/1984 Matsui ..... 200/406
5,079,394 A * 1/1992 Torma et al. ..... 200/407
5,089,715 A * 2/1992 Kokubu ..... 307/10.1
5,459,295 A * 10/1995 Ohta et al. ..... 200/461
5,947,269 A * 9/1999 Miyashita ..... 200/407
6,323,449 B1 * 11/2001 Janniere ..... 200/408
6,936,777 B1 * 8/2005 Kawakubo ..... 200/1 B

FOREIGN PATENT DOCUMENTS

FR 2 841 037 6/2002

* cited by examiner

*Primary Examiner*—Michael A. Friedhofer
(74) *Attorney, Agent, or Firm*—Peter Van Winkle

(57) ABSTRACT

A switch (10) comprising a bottom contact-holder (12) supporting two fixed electric contacts (30, 30B), an actuation member (54) and an intermediate conductive contact strip (14) that can be deformed elastically in order to modify the electric connection between the two fixed contacts (3030B) and that comprises two opposite longitudinal branches (40) connected to the front transverse contact arm (38B), characterized in that each branch (40) is curved and the switch comprises an actuation plate (16) which is interposed between the actuation member (54) and the contact strip (14) and which interacts with the tops (64) of the longitudinal branches (40) to deform the contact strip (14).

11 Claims, 2 Drawing Sheets

MINIATURIZED ELECTRIC SWITCH

CROSS-REFERENCE TO RELATED APPLICATION

Applicant claims priority from French patent application S.N. 0552083 filed Jul. 7, 2005.

BACKGROUND OF THE INVENTION

The present invention relates an electric switch. The invention relates more particularly to an electric switch of the normally closed type as described and represented in document FR-A1-2.841.037.

Such a switch is of the type comprising:

a bottom support forming a contact-holder made of insulating material that forms a housing in which at least two fixed electric contacts are placed;

an actuation member which operates on a vertical axis generally perpendicular to the base of the housing;

and a generally horizontal intermediate contact strip made of a conductive material that is interposed vertically between the actuation member and the base of the housing, that can be deformed elastically under the downward vertical action of the actuation member from a stable, rest state in order to modify the electric connection between the two fixed contacts and that comprises:

a front transverse movable contact arm in the form of a generally horizontal band which, at rest, presses on an associated fixed contact and which tilts about a horizontal transverse axis to break the electric connection between the said two fixed contacts, and two parallel and opposite branches in the form of longitudinally oriented bands whose front ends are connected to the front transverse contact arm.

In this document, the switch may or may not be of the tactile effect type.

The sudden change of state of a trigger member, interposed vertically between the actuation button and the contact strip provides its user, who acts directly or indirectly on the actuation button, with a tactile sensation or no tactile sensation of the change of state of the trigger member, and therefore of the change of state of the switch.

SUMMARY OF THE INVENTION

The object of the present invention is to propose an electric switch of the aforementioned type that is of the normally closed (NC) type, that is to say whose actuation or triggering action causes the electric connection to open, but has no tactile effect and has small dimensions.

With this objective, the invention proposes an electric switch of the aforementioned type, characterized in that each longitudinal branch is curved with its convexity oriented upwards, and in that the actuation member of the switch comprises a horizontal flat bottom actuation face in order to allow a generally elastic, symmetrical and simultaneous deformation of the contact strip.

Thus, thanks to the teachings of the invention, it is possible to produce an electric switch whose dimensions are particularly small and whose actuation and triggering action are particularly reliable and precise without causing harmful noises to occur at the time of the triggering or change of state of the intermediate contact strip, and without causing any inopportune and spurious bounce phenomenon.

According to other features of the invention:

the switch comprises a horizontal actuation plate that is interposed vertically between the actuation member and the contact strip and that interacts with the tops of the two curved longitudinal branches;

the tops of the two curved longitudinal branches are aligned transversely;

these aligned tops are offset longitudinally rearwards relative to the vertical axis of actuation;

each longitudinal branch is a rectilinear band comprising a bend delimiting the said top of the branch;

the rear longitudinal ends of the branches are connected via a transverse rear arm that presses on an adjacent surface portion of the base of the housing;

the front free end edge of the front transverse contact arm presses on the associated fixed contact when the contact strip is in its stable, rest state;

the fixed contact associated with the front transverse contact arm delimits, or forms, a top contact face that is coplanar with an adjacent surface portion of the base of the housing which delimits a horizontal transverse ridge on which the front transverse contact arm presses in order to tilt during its movement away from the associated fixed contact;

the two fixed contacts are offset vertically from one another, and in that the said fixed contact associated with the front transverse contact arm is the top contact;

the contact strip comprises a central contact branch which extends longitudinally rearwards from the front transverse contact arm, and vertically downwards with its rear free end section pressing on and in permanent electric contact with the bottom central fixed contact.

BRIEF DESCRIPTION OF THE DRAWINGS

Other features and advantages of the invention will appear on reading the following detailed description for the comprehension of which reference should be made to the appended drawings in which.

DETAILED DESCRIPTION OF THE INVENTION

In the following description, given as a non-limiting example, identical, analogous or similar components will be indicated by the same reference numbers.

In the description and the claims, the vertical, longitudinal and transverse orientations will be given, in a non-limiting manner, according to the orientation of the trihedral L, V, T indicated in the figures, and the front and rear orientations according to the left-right orientation with reference to the figures.

Figure 2:
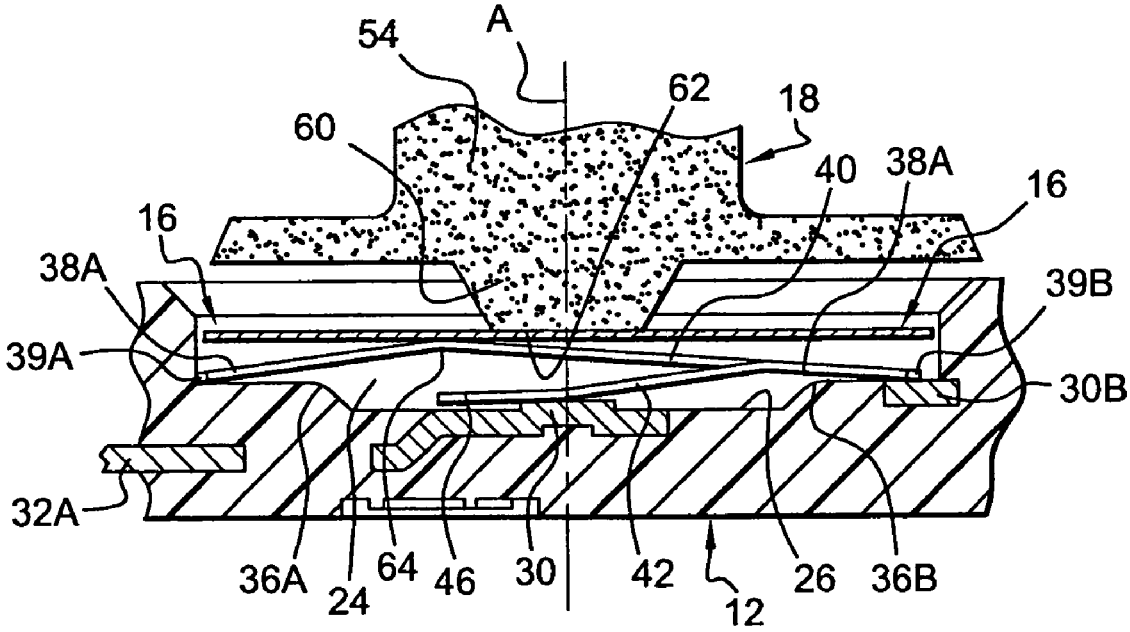
FIG. 2 is a detailed view on a larger scale, in longitudinal section along the vertical mid-plane of the switch represented in FIG. 1 and in which all the components are represented assembled with the switch at rest.

The figures represent a tactile effect electric switch 10 which here comprises, from bottom to top, a bottom casing 12 forming a fixed contact-holder made by molding in an insulating material, an intermediate contact strip 14 made of conductive material, a horizontal actuation plate 16, an actuation member 18 with vertical action, and a top cage 20 for closing the switch which in particular holds all the components in the assembled position as illustrated in FIG. 2.

The casing 12, of a generally known design, is of generally rectangular parallelepipedic shape and it is open in its top face 22 delimiting, or forming an internal cavity 24.

The cavity 24 comprises a horizontal bottom base staged on two levels, that is to say that it comprises a first central portion 26 at the lowest level, that is horizontal and has a rectangular contour, and a second higher level portion offset upwards consisting of two portions, a rear portion 28A and a front portion 288, each of rectangular contour, and that are arranged symmetrically either side of the central portion 26 and that are coplanar.

Except for the fixed contacts, which will be described hereinafter, the bottom contact-holder 12 (like the actuation member 18 and the cage 20) has a general symmetry of design relative to the longitudinal and transverse vertical mid-planes not shown in the figures.

The two fixed contacts comprise a first central and bottom fixed contact 30 arranged in the portion 26 of the base of the cavity 24 that is a cut-out element comprising a rear electric connection tab 32A which protrudes longitudinally out of the insulating body of the bottom casing or contact-holder 12.

Figure 1:
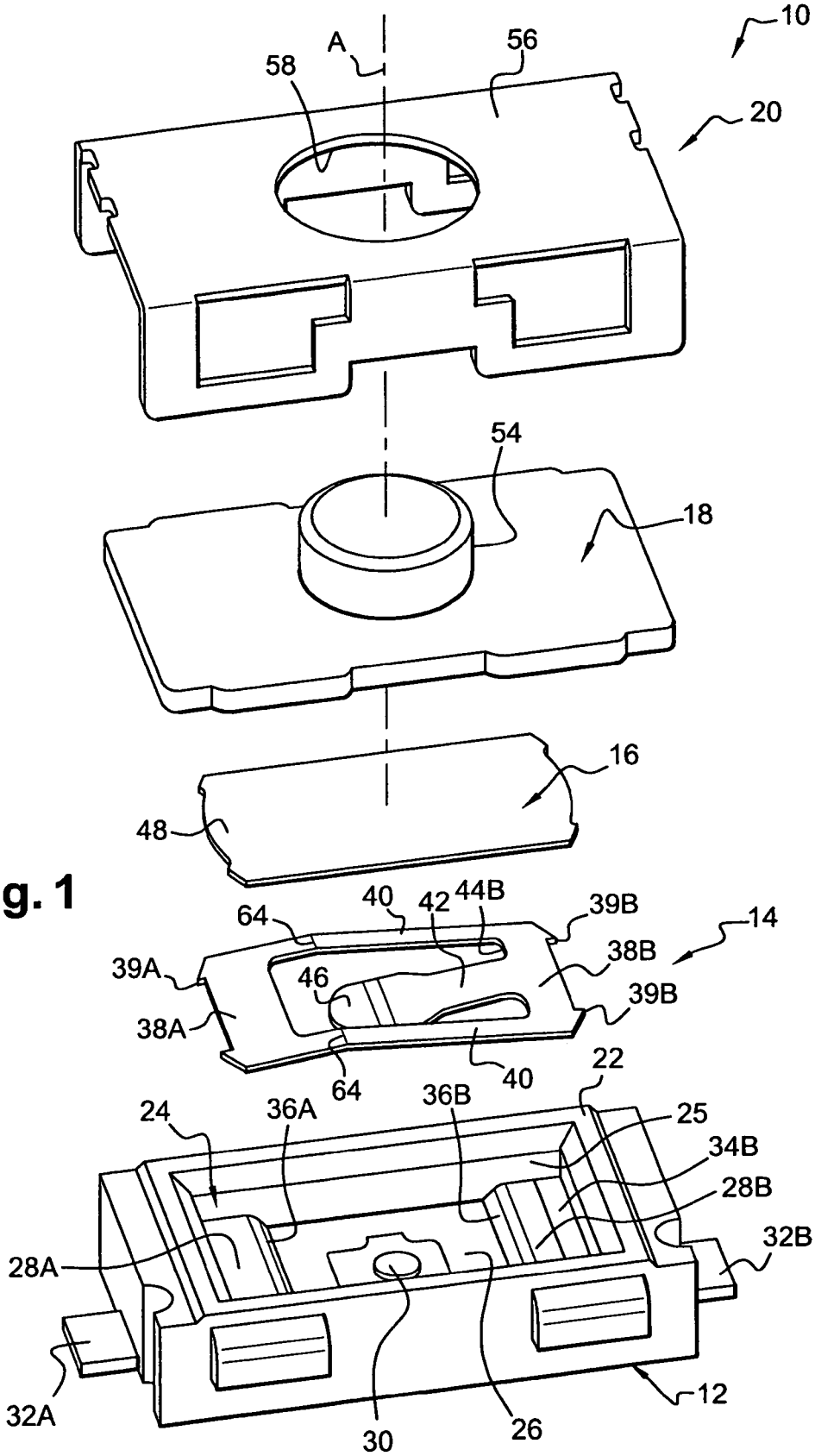
FIG. 1 is an exploded isometric view that illustrates the main components of an exemplary embodiment of an electric switch according to the invention.
Figure 3:
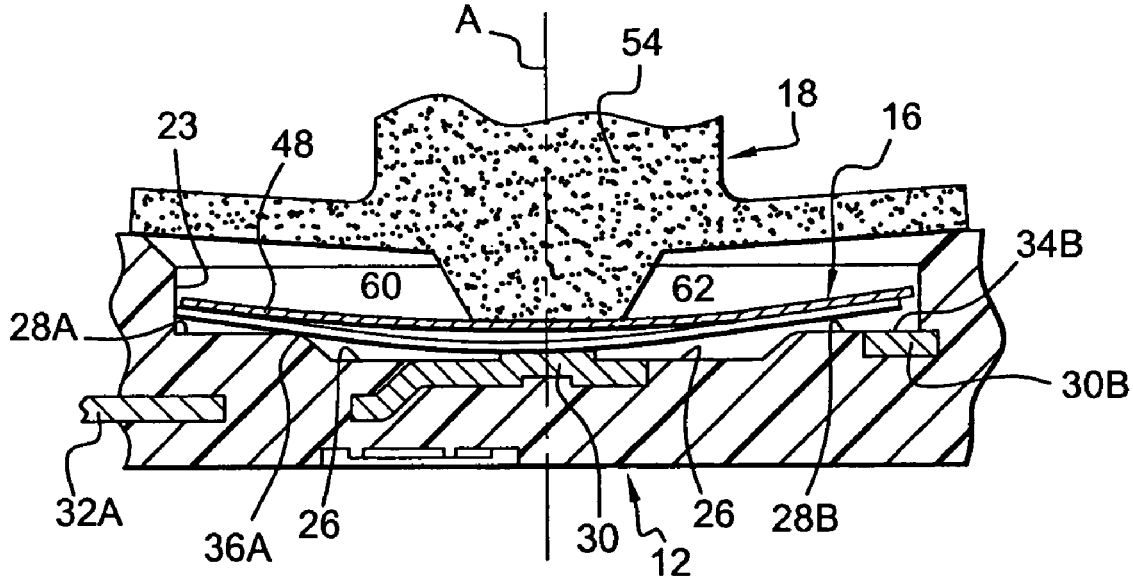
FIG. 3 is a view similar to that of FIG. 2 in which all the components are represented after the actuation of the switch to break the electric connection between the two fixed contacts.

The second front fixed contact 30B is arranged, on the right when looking at FIGS. 1 to 3, in the upper base portion 28B so that its top free contact face 34B is flush and coplanar with the adjacent portion 28B of the base of the cavity.

The fixed contact 30B also comprises a front lateral connection tab 32B which protrudes longitudinally to the right from the body made of insulating material of the bottom contactholder 12 that is overmolded around the fixed contacts according to a known technique.

As can be seen in the figures, each top portion 28A, 28B of the base of the housing 24 is limited longitudinally inwards by a horizontal and transverse ridge 36A, 36B.

The intermediate contact strip 14, in the general shape of a recessed rectangular plate or of a generally rectangular frame, is designed so that it is always in electric contact with the central fixed contact 30 irrespective of the state of the switch 10.

The frame-shaped intermediate strip 14 essentially consists of two transverse and opposite movable contact arms, a rear arm 38A and front arm 38B, that have the shape of two flat rectangular bands that extend parallel to one another and horizontally, in the transverse direction, and that are connected together by two parallel and opposite branches 40, in the shape of bands of generally horizontal longitudinal orientation, so as to allow a generally elastic, symmetrical and simultaneous deformation of the intermediate contact strip 14 as will be explained hereinafter.

The strip 14 is made of conductive material and it also comprises a central contact branch 42 which extends longitudinally inwards from the inner lateral edge 44B of the front transverse arm 38B and which extends towards the center, and vertically downwards, so that its free, pellet-shaped end section 46 presses on and is in permanent electric contact with the central fixed contact 30.

The intermediate contact strip extends substantially in a horizontal plane with the central branch 42 which, for its part, extends vertically downwards below the mid-plane of the strip 14.

When the strip 14 is in its stable, rest state, that is to say not elastically deformed, illustrated in FIGS. 1 and 2, the right lateral arm 38B presses horizontally, at least by its front longitudinal end contact edge 39B with the top conducting face 34B of the right lateral fixed contact 30B.

The front transverse arm 38B thus forms the front transverse contact arm of the intermediate contact strip 14 and the two fixed contacts 30 and 30B are then electrically connected via the contact strip 14, that is to say that the switch 10 is of the normally closed (NC) type.

When the user presses on the contact strip 14 to deform it in order to cause a change of state of the switch 10, and as can be seen illustrated schematically in FIG. 4, the central branch 42, 46 remains in contact with the central fixed contact 30, while the section or lateral arm 38B, under the effect of the deformation of the contact strip 14, changes position so as to break its electric contact with the lateral fixed contact 30B.

Accordingly, the arm 38B is caused generally to tilt about a horizontal transverse axis parallel to the ridge 36B which thus forms a pivoting or tilting horizontal axis for the arm 38B which is no longer in contact in any way with the top face 34B of the lateral fixed contact 30B, see FIG. 3.

Thus, the electric connection between the two fixed contacts 30 and 30B that is provided by the strip 14, is broken, that is to say that the switch, in its actuated state, is in an electrically open state.

The top actuation member or actuator 18 is a deformable element whose central, button-shaped portion 54, accessible from the outside above the top face 56 of the cage 20 protruding through a central hole 58 of the latter, extends downwards via a bottom actuation end 60 whose horizontal flat bottom actuation face 62 permanently interacts with the opposite portion of the central part of the top face 48 of the horizontal actuation plate 16.

The plate 16 is a metal plate which, in its elastically undeformed rest state is flat and horizontal, is interposed vertically between the flat horizontal bottom actuation face 62 of the actuation button 54 and the longitudinal branches 40 that connect the rear transverse arms 38A and 38B.

Each branch 40 is curved with its convexity oriented upwards and is shaped due to an intermediate bend 64.

The two bends 64 are aligned transversely and are offset longitudinally rearwards relative to the central vertical axis of actuation A of the actuation button 54.

In the rest state of the switch, the tops 64 are substantially at the same height and are offset vertically upwards relative to the horizontal line passing through the longitudinal end edges 39A and 39B.

The contour or periphery of the actuation plate 16 and of the contact strip 14 are substantially identical.

In the mounted and assembled state of the components, the axial stack 18, 16 and 14 is slightly elastically prestressed so as to hold all the components without clearance.

The plate 16 and the strip 14 are housed and held laterally, with a slight transverse and longitudinal clearance, inside the cavity 24 between the transverse vertical lateral face 23 and the longitudinal vertical lateral face 25 which form the cavity 24.

When the user presses vertically down on the button 54, its bottom end 60 acts on the central part of the actuation plate 16 which elastically deforms and acts on the bends 64 of the branches 40.

The conformation of the intermediate contact strip with its bent branches 40 and its interaction with the intermediate actuation plate 16 force the contact strip 14 to change state and to deform to adopt the profile illustrated in FIG. 3.

The strip 14 behaves in this way as a movable contact element which changes state by "returning".

The intermediate contact strip 14 remains in its deformed state, represented schematically in FIG. 4, so long as the user does not relax the action on the button 54 of the actuator 18.

Since the actuation plate 16 is interposed vertically between the contact strip 14 and the actuator 18, it may be metallic and therefore a conductor of electricity because, in its stable, rest state, which also corresponds to the stable, rest state of the strip 14, the assembly 14–16 forms an electrically conducting assembly and because, in its deformed state, it is immaterial that its central conducting part comes into electric contact with the end section 46 of the branch 42 of the intermediate contact strip 14 because the electric connection is opened at the lateral arm 38B and the lateral fixed contact 30B.

The second embodiment illustrated in FIGS. 5 and 6 will now be described, more particularly in comparison with the first embodiment described in FIGS. 1 to 3.

As a variant not shown, it is possible to provide two top fixed contacts arranged symmetrically and laterally with their top conductive faces coplanar with the adjacent portions of the lateral parts 28A and 28B of the base of the cavity.

At rest, the two end transverse edges 39A and 39B of the intermediate contact strip 14 are then each in contact with a top fixed contact, the contact strip 14 symmetrically pressing in vertical contact, particularly via its transverse bottom edges 39A and 39B, on the opposite unobstructed portions of the top face of the lateral fixed contacts.

When the user presses on the central part of the plate 16 by means of the button 54–60, he causes the change of state of the contact strip 14 which therefore causes the simultaneous tilting or pivoting of the two movable contact arms 38A and 38B which tilt so as to virtually simultaneously break the electric contact between each movable contact arm 38A, 38B with its associated top lateral fixed contact.

The design according to the invention also makes it possible to use the same components to produce either a switch of the tactile effect type as represented in document FR-1-2.841.037 or a switch according to the invention, by replacing the trigger member with an actuation plate 16 and by using a contact strip with bent branches 40.

The presence of the actuation plate is not obligatory in the context of the present invention. According to a variant not shown, it may be omitted and, in this case, it is the horizontal flat bottom actuation face 62 of the actuation member 54 that is dimensioned and positioned so as to be able to act directly on the curved branches.

What is claimed is:

1. An electric switch (10) comprising:

a bottom support (12) forming a contact-holder of insulating material that forms a cavity (24) in which at least two fixed electric contacts (30, 30B) are placed;

an actuation member (54) which operates on a vertical axis (A) generally perpendicular to a base (28A, 28B) of the cavity (24);

and a generally horizontal intermediate contact strip (14) of a conductive material that is interposed vertically between the actuation member (54) and the base of the cavity (24), that can be deformed elastically under a downward vertical action of the actuation member (54) from a stable, rest state in order to modify an electric connection between the at least two fixed contacts (30–30B);

said intermediate contact strip includes a front transverse movable contact arm (38B) in the form of a generally horizontal band which, at rest, presses on an associated one of the fixed contacts (30B) and which tilts about a horizontal transverse axis to break the electric connection between the at least two fixed contacts (30, 30B);

said intermediate contact strip also includes two parallel and opposite branches (40) in the form of bands whose front ends are connected to the front transverse contact arm (38B), each of the branches (40) is curved with a convexity oriented upwards, and the actuation member (54) of the switch comprises a horizontal flat bottom actuation face (62) in order to allow a generally elastic, symmetrical and simultaneous deformation of the contact strip (14).

2. A switch according to claim 1, characterized in that the switch comprises a horizontal actuation plate (16) that is interposed vertically between the actuation member (54) and the contact strip and that interacts with tops (64) of the two curved longitudinal branches (40).

3. A switch according to claim 2, characterized in that the horizontal flat bottom actuation face (62) of the actuation member (54) presses on an opposite portion of a top face (48) of the actuation plate (16).

4. A switch according to claim 1, characterized in that a tops (64) of the two curved longitudinal branches (40) are aligned transversely.

5. A switch according to claim 4, characterized in that the aligned tops (64) are offset longitudinally rearwards relative to the vertical axis of actuation (A).

6. A switch according to claim 1, characterized in that each longitudinal branches (40) is a rectilinear band comprising a bend forming a top (64) of the branch (40).

7. A switch according to claim 1, characterized in that rear longitudinal ends of the branches (40) are connected via a transverse rear arm (38A) that presses on an adjacent surface portion (28A) of the base of the cavity (24).

8. A switch according to claim 1, characterized in that a front free end edge (39B) of the front transverse contact arm (38B) presses on the associated fixed contact (30B) when the contact strip (14) is in a stable, rest state.

9. A switch according to claim 1, characterized in that the fixed contact (30B) associated with the front transverse contact arm (38B) has a top contact face (34B) that is coplanar with an adjacent surface portion (28B) of the base of the cavity (24) which forms a horizontal transverse ridge (36B) on which the front transverse contact arm presses in order to tilt during movement away from the associated fixed contact (30B).

10. A switch according to claim 1, characterized in that the two fixed contacts (30, 30B) are offset vertically from one another, and in that the fixed contact associated with the front transverse contact arm (38B) is the top contact (30B).

11. A switch according to claim 10, characterized in that the contact strip (14) comprises a central contact branch (42) which extends longitudinally rearwards from the front transverse contact arm (38B), and vertically downwards with a rear free end section pressing on and in permanent electric contact with the bottom central fixed contact (30).

* * * * *